US010120330B2

(12) United States Patent
Satomura et al.

(10) Patent No.: US 10,120,330 B2
(45) Date of Patent: Nov. 6, 2018

(54) MULTICOLOR MOLDED COMPONENT HAVING A BEARING PORTION THAT ENGAGES WITH REGULATION PORTIONS AND CARTRIDGE HAVING THE SAME

(71) Applicant: CANON KABUSHIKI KAISHA, Tokyo (JP)

(72) Inventors: Shogo Satomura, Kawasaki (JP); Kazuki Matsumoto, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/836,806

(22) Filed: Aug. 26, 2015

(65) Prior Publication Data

US 2016/0062309 A1 Mar. 3, 2016

(30) Foreign Application Priority Data

Aug. 29, 2014 (JP) ..... 2014-176309

(51) Int. Cl.
*G03G 21/18* (2006.01)
*G03G 21/16* (2006.01)
*G03G 21/00* (2006.01)

(52) U.S. Cl.
CPC ..... *G03G 21/169* (2013.01); *G03G 21/0058* (2013.01); *G03G 21/1814* (2013.01); *G03G 21/1821* (2013.01)

(58) Field of Classification Search
CPC ..... G03G 21/18; B29C 45/0017
USPC ..... 399/111
See application file for complete search history.

(56) References Cited

U.S. PATENT DOCUMENTS 5,884,124 A * 3/1999 Karakama ..... G03G 21/12 399/111
6,070,029 A * 5/2000 Nishiuwatoko .... G03G 21/1821 399/111
2011/0222903 A1* 9/2011 Kishi ..... G03G 21/1821 399/111
2012/0207506 A1* 8/2012 Honobe ..... G03G 15/0216 399/89
2012/0269545 A1* 10/2012 Morita ..... G03G 21/1825 399/111
2013/0022368 A1* 1/2013 Takarada ..... G03G 21/1867 399/110
2013/0272753 A1* 10/2013 Fukasawa ..... G03G 21/18 399/279

FOREIGN PATENT DOCUMENTS

JP H07-160176 A 6/1995
JP 2011-95536 A 5/2011

* cited by examiner

*Primary Examiner* — Walter L Lindsay, Jr.
*Assistant Examiner* — Philip Marcus T Fadul
(74) *Attorney, Agent, or Firm* — Canon U.S.A., Inc. IP Division

(57) ABSTRACT

A multicolor molded component used in an image forming apparatus includes a molded portion molded with a first resin, and a bearing portion configured to be movable with respect to the molded portion, and to support a rotating member. The molded portion includes a regulation portion, and the bearing portion is formed by injection molding to be engaged with the regulation portion in such a manner as to be movable in a first direction with respect to the molded portion.

9 Claims, 9 Drawing Sheets

MULTICOLOR MOLDED COMPONENT HAVING A BEARING PORTION THAT ENGAGES WITH REGULATION PORTIONS AND CARTRIDGE HAVING THE SAME

BACKGROUND OF THE INVENTION

Field of the Invention

The present invention relates to a multicolor molded component used in an image forming apparatus, and a cartridge detachably attached to an apparatus main body of an image forming apparatus.

Description of the Related Art

Conventionally, a cartridge system as follows has been used in an electrophotographic image forming apparatus (hereinafter referred to as an image forming apparatus): a process unit is formed integrally into a cartridge, and this process cartridge (hereinafter referred to as a cartridge) is detachably attached to the image forming apparatus. In such a cartridge system, in order to keep a state in which a process unit is stably in contact with a photosensitive drum, a configuration in which the process unit is movably supported is used. For example, the following configuration is known: a charging roller, which is a charging unit, is supported via a bearing member that is movable in one direction, so as to be in contact with a photosensitive drum in a stable state (see Japanese Patent Application Laid-Open No. 2011-95536).

Further, the following configuration is known: a developing roller, which is a developer bearing member, is supported via a bearing member that is movable in one direction, so as to be in contact with a photosensitive drum in a stable state (see Japanese Patent Application Laid-Open No. 7-160176).

SUMMARY OF THE INVENTION

According to an aspect of the present invention, a multicolor molded component used in an image forming apparatus includes a molded portion molded with a first resin, and a bearing portion configured to be movable with respect to the molded portion, and to support a rotating member. The molded portion includes a regulation portion, and the bearing portion is formed by injection molding to be engaged with the regulation portion in such a manner as to be movable in a first direction with respect to the molded portion.

According to another aspect of the present invention, a cartridge detachably attached to an apparatus main body of an image forming apparatus, includes a process unit configured to act on an image bearing member for performing image formation, a bearing portion configured to rotatably support the process unit, and a supporting portion configured to movably support the bearing portion. The supporting portion includes a regulation portion, and the bearing portion is formed by injection molding to be engaged with the regulation portion in such a manner as to be movable in a first direction with respect to the supporting portion.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings. The sizes, materials, shapes and relative arrangements of components described in these exemplary embodiments are to be appropriately changed according to a configuration of an apparatus to which the invention is applied and various conditions, and are not intended to limit the scope of the present invention to the exemplary embodiments described below.

The present invention relates to a multicolor molded component used in an image forming apparatus, and to a cartridge detachably attached to an apparatus main body of an image forming apparatus. Here, examples of the image forming apparatus include an electrophotographic image forming apparatus for forming an image on a recording material by using an image forming process of an electrophotographic type, and an ink jet recording device of a liquid discharge recording type. Examples of the electrophotographic image forming apparatus include an electrophotographic copier, an electrophotographic printer (for example, a laser beam printer and a light emitting diode (LED) printer), a facsimile device, and a word processor.

Further, the "cartridge" collectively refers to a drum cartridge that supports a photosensitive drum (electrophotographic photosensitive member), a developing cartridge that supports a developing unit, and a cartridge obtained by integrating an electrophotographic photosensitive drum and a process unit into a cartridge.

A process unit acts on an electrophotographic photosensitive drum. Examples of the process unit include a charging unit, a developing unit, a cleaning unit, and the like that act on an electrophotographic photosensitive drum, as well as a toner supply roller that applies toner to a developer bearing member (developing roller) as a developing unit, and a remaining toner amount detection unit.

The following describe an image forming apparatus and a cartridge according to a first exemplary embodiment with reference to the drawings.

[Schematic Configuration of Electrophotographic Image Forming Apparatus]

Figure 1A:
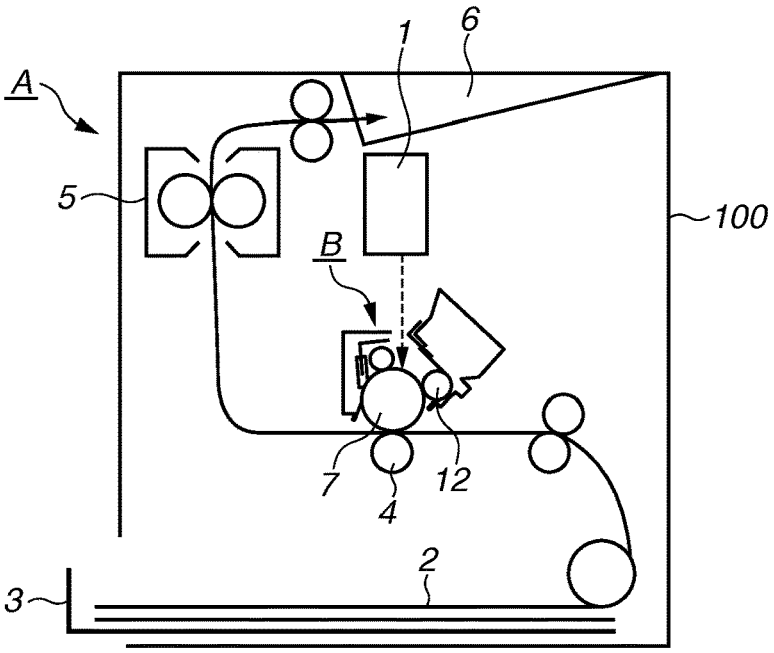
FIGS. 1A and 1B are schematic cross-sectional views illustrating an image forming apparatus and a cartridge according to an exemplary embodiment.
Figure 1B:
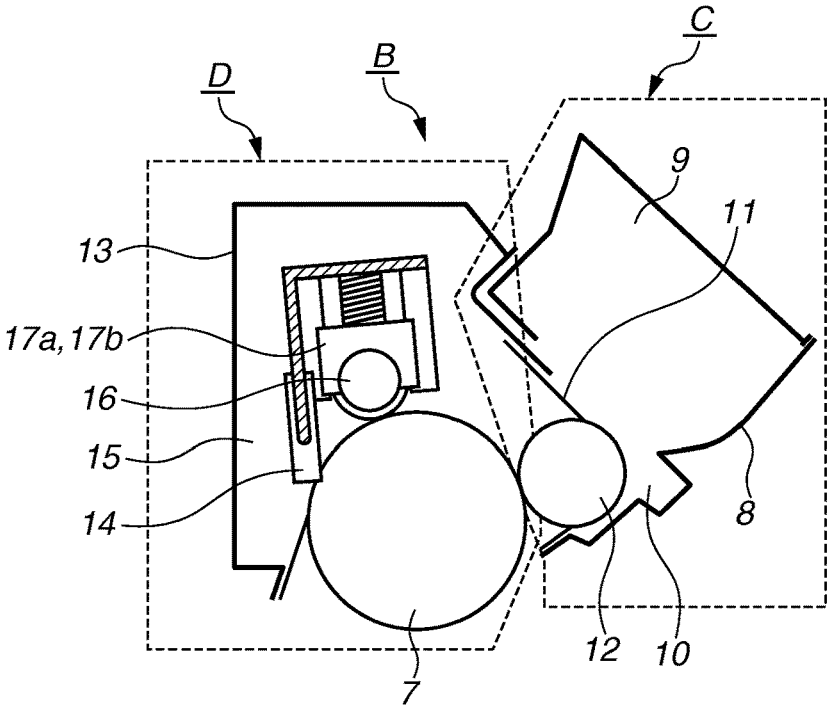

First, the entire configuration of an electrophotographic image forming apparatus will be described with reference to FIGS. 1A and 1B. FIG. 1A is a schematic cross-sectional view illustrating the entire configuration of an image forming apparatus to which a process cartridge according to an exemplary embodiment of the present invention is attached. In the present exemplary embodiment, the description will be given of a monochrome color laser beam printer as an example of an image forming apparatus. The present invention, however, is not limited to this, and is applicable to other image forming apparatuses such as a full color printer, a copying machine, a facsimile, and an ink jet printer.

As illustrated in FIG. 1A, in an image forming apparatus A, information light (laser light) that is based on image information is radiated from an optical device 1 onto a photosensitive drum 7 as an image bearing member, so that an electrostatic latent image is formed on the photosensitive drum 7. Then, a developing roller 12 as a developer bearing member develops this latent image with a developer (hereinafter referred to as toner) to visualize the latent image, thereby forming a toner image. In synchronization with the formation of the toner image, a recording material 2 is conveyed from a feeding cassette 3, and the toner image formed on the photosensitive drum 7 is transferred by a transfer roller 4 onto the recording material 2. This transferred toner image is fixed on the recording material 2 by a fixing unit 5, and then, the recording material 2 is discharged to a discharge unit 6.

[Schematic Configuration of Cartridge]

Next, a configuration of the cartridge will be described with reference to FIGS. 1A and 1B. FIG. 1B is a schematic cross-sectional view illustrating a schematic configuration of a cartridge B according to the present exemplary embodiment.

The cartridge B has a configuration in which a developing device C and a drum device D are combined so as to be relatively rotatable, and the cartridge B is detachably attached to an apparatus main body 100 of the image forming apparatus A. Here, the developing device C includes a developing unit and a development frame member 8. The developing device C includes toner (not illustrated), the developing roller 12, and the like. The development frame member 8 contains toner therein and supports the developing unit. Further, the drum device D includes components such as the photosensitive drum 7 and a cleaning blade 14, as well as a drum frame member 13 that supports these components.

Toner contained in a toner containing unit 9 of the developing device C is sent to a developing chamber 10, and a toner layer is formed on the surface of the developing roller 12 to which frictional electrification charge is applied by a developing blade 11. Then, the toner provided on the surface of the developing roller 12 is transferred onto the photosensitive drum 7 according to the latent image, whereby a toner image is formed on the photosensitive drum 7. After the toner image on the photosensitive drum 7 is transferred onto the recording material 2 by the transfer roller 4, toner remaining on the photosensitive drum 7 is scraped off by the cleaning blade 14, whereby the residual toner is collected (removed) to a waste toner reservoir 15. Thereafter, the surface of the photosensitive drum 7 is uniformly charged by a charging roller 16 as a charging member (process unit), thereby causing a state in which a latent image can be formed by the optical device 1.

[Schematic Configuration of Drum Device]

Figure 2:
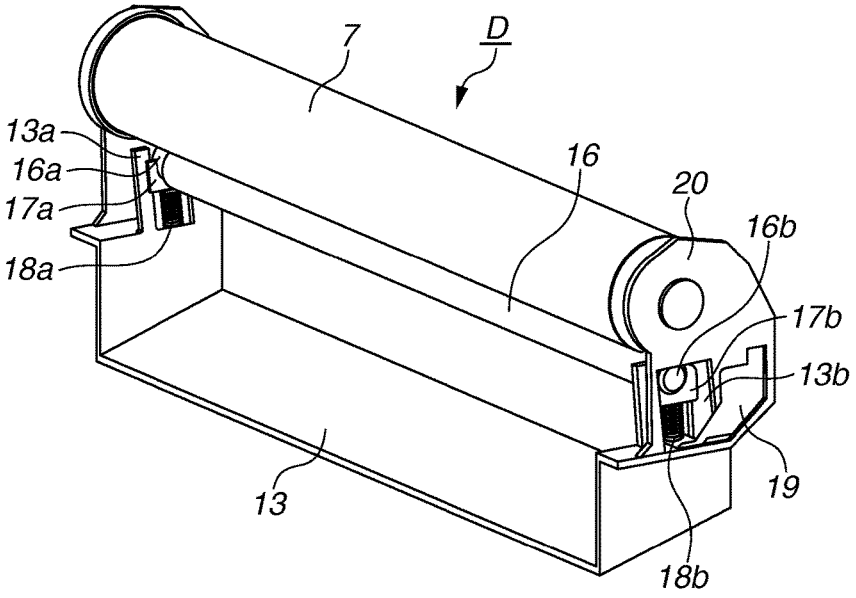
FIG. 2 is a schematic configuration diagram illustrating a drum device part according to a first exemplary embodiment.

Next, the drum device D according to the present exemplary embodiment will be described with reference to FIG. 2. FIG. 2 is a schematic configuration diagram illustrating parts involved in a charging process for charging the drum device D according to the present exemplary embodiment.

The following describes a schematic configuration of parts involved in the charging process for charging the drum device D. As illustrated in FIG. 2, the charging roller 16 (rotating member) for charging the surface of the photosensitive drum 7 has shaft end portions 16*a* and 16*b* both being rotatably supported by charging roller bearings (charging roller terminals) 17*a* and 17*b*, respectively. The charging roller bearings 17*a* and 17*b* are engaged and molded integrally with charging roller bearing supporting portions 13*a* and 13*b* of the drum frame member 13 (molded portion), respectively, in such a manner as to be movable in a direction toward the photosensitive drum 7, for example, in a direction toward the rotation center of the photosensitive drum 7. Then, conductive compression springs 18*a* and 18*b* are fixed in a compressed state, so that the charging roller bearings 17*a* and 17*b* are respectively urged to be pressed against photosensitive drum 7. As a result, in a state in which the photosensitive drum 7 and the charging roller 16 are in contact with each other, the charging roller 16 is configured to be urged at a predetermined pressure toward the photosensitive drum 7 by spring elastic forces of the compression springs 18*a* and 18*b*.

Figure 3:
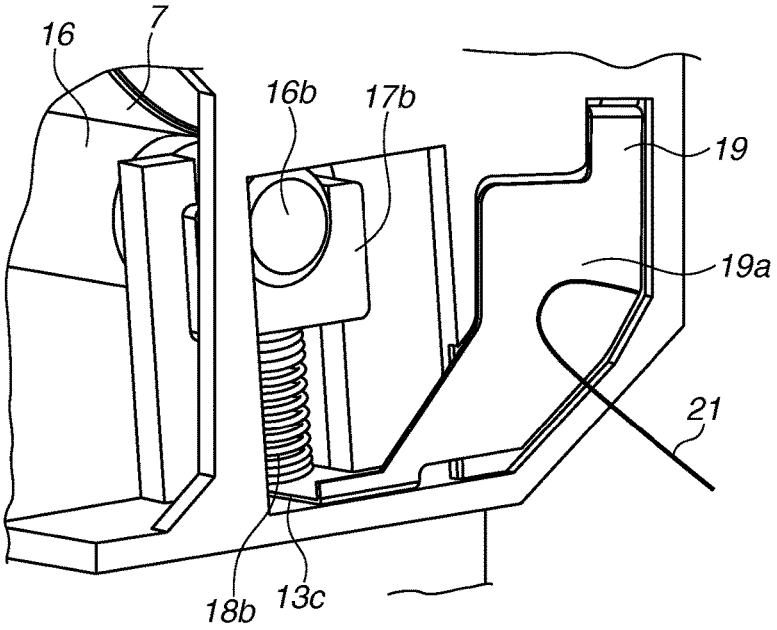
FIG. 3 is a schematic perspective view illustrating a main body contact point in a contact state according to the first exemplary embodiment.

Next, a charging method for charging the photosensitive drum 7 will be described with reference to FIG. 3. FIG. 3 is a schematic perspective view illustrating a contact state of a side surface portion of the drum frame member 13 on the contact point side and a main body contact point. As illustrated in FIG. 3, a contact point portion 19*a* of an electrode member 19 is attached to the side surface portion of the drum frame member 13, so as to be exposed. The electrode member 19 extends, in the longitudinal direction thereof, from the contact point portion 19*a* toward the center side of the drum frame member 13. The center-side end portion of the electrode member 19 in the longitudinal direction is supported by an installation surface 13*c*, and is arranged so as to be in contact with an end of the compression spring 18*b*. The other end of compression spring 18*b* is configured to be in contact with the charging roller bearing 17*b*.

With this configuration, when the process cartridge B is attached to the apparatus main body 100, a main body electrode 21, which is a main body contact point member installed in the apparatus main body 100, and the contact point portion 19*a* of the electrode member 19 are brought into contact with each other. Subsequently, when a voltage is output to the main body electrode 21 according to a command from a controller (not illustrated) of the apparatus main body 100, a voltage is applied from the end portion 16*b* of the shaft of the charging roller 16 to the surface of the charging roller 16 via the electrode member 19, the compression spring 18*b*, and the charging roller bearing 17*b*. Then, the charging roller 16 can uniformly charge the surface of the photosensitive drum 7.

[Multicolor Molding Method of Bearing]

Figure 4A:
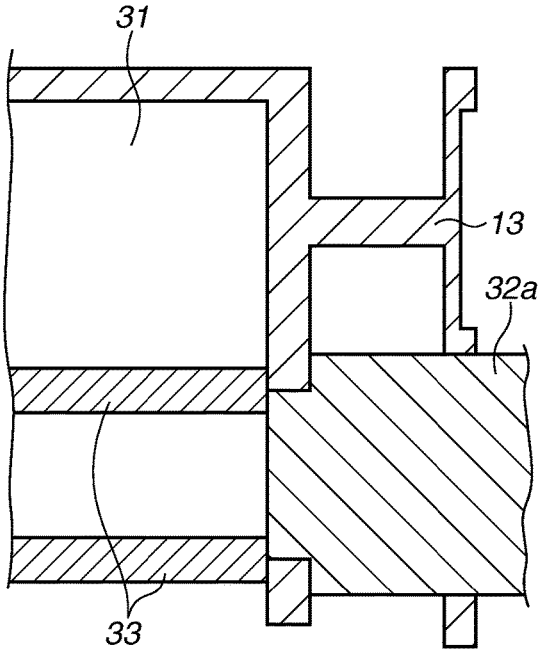
FIGS. 4A and 4B are schematic views illustrating a configuration example of a main body contact point in a contact state according to the first exemplary embodiment.
Figure 4B:
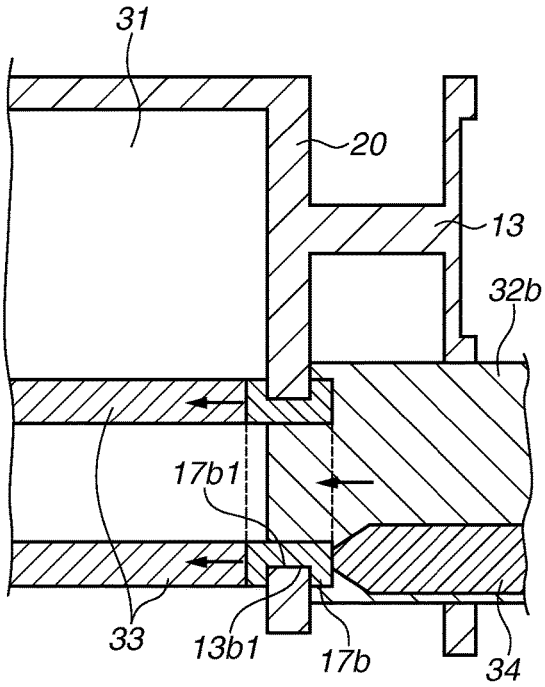

Next, a multicolor molding method of the bearing portion according to the present exemplary embodiment will be described with reference to FIGS. 4A and 4B. Here, a method for manufacturing a multicolor molded component 20 in which the charging roller bearing 17*b* and the drum frame member 13 are integrally formed will be described as the first exemplary embodiment, with reference to FIGS. 4A and 4B.

First, the drum frame member 13 formed with a first resin is prepared. Alternatively, as illustrated in FIG. 4A, the first resin is injected via a first gate (not illustrated) into spaces formed between a frame member molding mold 31, a first insertion mold 32*a*, and a slide mold 33, so that the drum frame member 13 is formed. Thereafter, a second resin is injected via a second gate 34 into a bearing molding space formed in the drum frame member 13 by the frame member molding mold 31, a second insertion mold 32*b*, and the slide mold 33, so that the charging roller bearing 17*b* is formed. Further, in a case where the drum frame member 13 and the charging roller bearing 17*b* are sequentially formed, as illustrated in FIG. 4B, the first insertion mold 32*a* is replaced with the second insertion mold 32*b*, and the slide mold 33 is slid so that the bearing molding space is formed. Then, the second resin is injected via the second gate 34 into this bearing molding space, whereby the charging roller bearing 17*b* is formed.

Here, the charging roller bearing supporting portion 13*b* as a part of the drum frame member 13 is used as a mold, so that the charging roller bearing 17*b* is molded. More specifically, a shape of contact portions 13*b*1 of the charging roller bearing supporting portion 13*b* is transferred, thereby forming a charging roller bearing 17*b* that includes bearing contact portions 17*b*1 having a shape according to the contact portions 13*b*1. In other words, there is formed the charging roller bearing 17*b* that is engaged with the rail-shaped charging roller bearing supporting portion 13*b* (regulation portion) for regulating the movement direction. With this configuration, if the contact portions 13*b*1 are formed with high accuracy, it becomes possible to form the bearing contact portions 17*b*1 easily with high accuracy as well. Thus, in the case of the conventional method where separate components are assembled, contact portions of the respective components need to be formed with high accuracy in order to suppress rattling between the components, but in the case where the present invention is used, the rattling between the components can be easily suppressed, and the assembling with high accuracy is enabled.

In the present exemplary embodiment, a material (for example, conductive resin) that is incompatible with a material for the drum frame member 13 and is conductive is used for forming the charging roller bearings 17*a* and 17*b*. Generally, the "compatibility" refers to that substances of a plurality of types mutually have affinity and form a mixture. In contrast, "incompatibility" generally refers to that resins of a plurality of types do not mix with one another at contact interfaces thereof. In the present exemplary embodiment, "incompatibility" refers to that resins that are integrally molded by multicolor molding are easily separable at contact interfaces thereof.

For example, in frame members, components, and the like, polystyrene (PS)-based resins are widely used. Examples of resins that are incompatible with PS-type resins when being combined therewith include polyethylene (PE), polypropylene (PP), polyamide (PA), polyethylene terephthalate (PET), and polyacetal (POM). Further, since POM, which is a crystalline resin that is widely used in a bearing member, has little compatibility unless the same materials are combined, it is sufficient that materials other than POM is used for being combined with the POM, as combinations of incompatible resins. In the case of acrylonitrile butadiene styrene resin (ABS), polycarbonate (PC), and the like, which are non-crystalline resins, the preferable combinations are those other than, for example, the combination of ABC and PC, the combination of ABS and PS, as well as combinations of the same materials. Examples of the combination of incompatible resins include the combinations of ABS and PA, PC and PE, PP, or the like, and these resins are preferably used in combination.

Further, as the conductive material, materials obtained by dispersing particular or fibrous conductive materials such as carbon fiber, other particles made of metals and the like in resins mentioned above as base material resins can be used. In the present exemplary embodiment, carbon black is used so that damage to production devices due to friction and the like should be decreased as much as possible. Here, "conductive" refers to having conductivity of 30 Ω·cm or less measured by a measurement method defined by JIS K 7194, and "non-conductive" refers to having conductivity greater than 30 Ω·cm.

In the present exemplary embodiment, as resins combined for two-color molding, a PS-based resin is used as a material for the drum frame member 13, and conductive POM containing about 10% of carbon black is used as a material for the charging roller bearing 17*b*. In this way, by using a combination of incompatible resins, the resins are separable at contact interfaces even after the resins are integrally molded by two-color molding, whereby the charging roller bearing 17*b* can be movable with respect to the drum frame member 13.

Figure 5A:
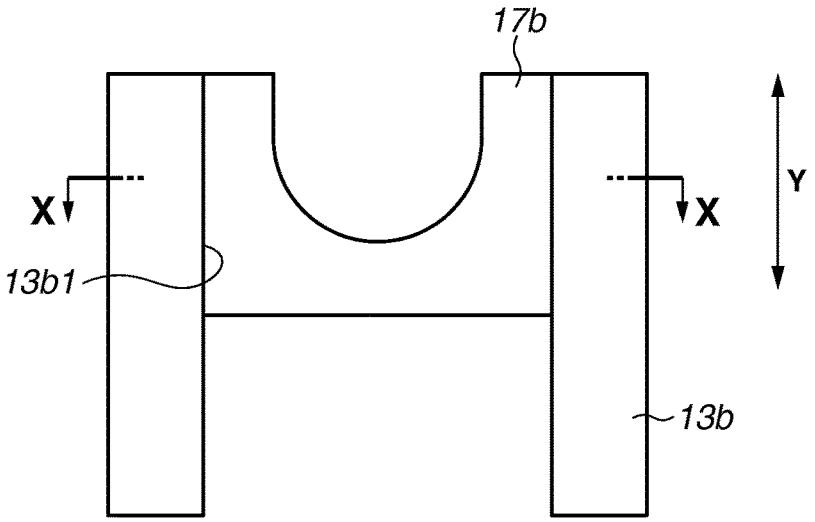
FIGS. 5A and 5B are schematic cross-sectional views illustrating molding of a charging roller bearing according to the first exemplary embodiment.
Figure 5B:
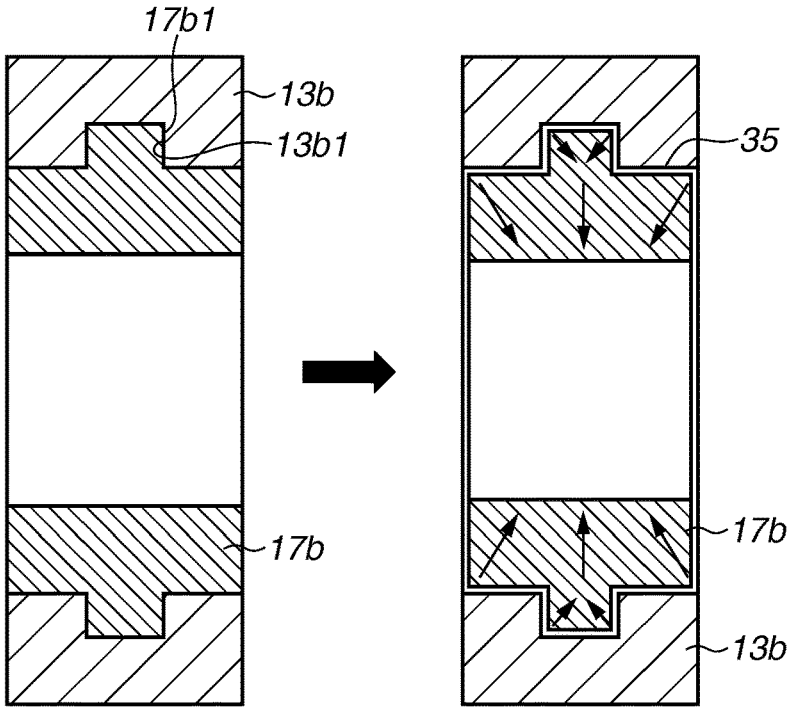

Next, a shape of the contact portion for enabling the charging roller bearing 17*b* molded on the drum frame member 13 by multicolor molding to be movable with respect to the drum frame member 13 will be described by way of examples, with reference to FIGS. 5A to 6B. FIGS. 5A and 5B are schematic diagrams illustrating a shape of the contact portion according to the first exemplary embodiment. FIG. 5A is a schematic diagram of a perspective view viewed from the side surface, and FIG. 5B schematically illustrates cross sections of the charging roller bearing 17*b* taken along a line X-X in FIG. 5A, immediately after the molding and after a predetermined period of time elapses.

In the present exemplary embodiment, as illustrated in FIG. 5A, the charging roller bearing 17*b* is movably molded along the charging roller bearing supporting portion 13*b* of the drum frame member 13, so as to be movable in a direction toward the photosensitive drum 7, for example in a direction toward the rotation center of the photosensitive drum 7.

Here, as illustrated in FIG. 5B, the bearing contact portions 17*b*1 of the charging roller bearing 17*b* are formed so as to be interposed in the charging roller bearing supporting portion 13*b*, so as to be in contact with the contact portions 13*b*1. After a predetermined period of time elapses, the molten resin for forming the charging roller bearing 17*b* is cooled and shrinks, which generates a gap 35 between itself and the charging roller bearing supporting portion 13*b*. The charging roller bearing 17*b* is therefore movably supported with respect to the charging roller bearing supporting portion 13*b*. The gap 35 formed herein is about 20 μm in a case where POM, for example, is used as the second resin for forming the charging roller bearing 17*b*, and the thickness thereof is 1 mm.

Figure 6A:
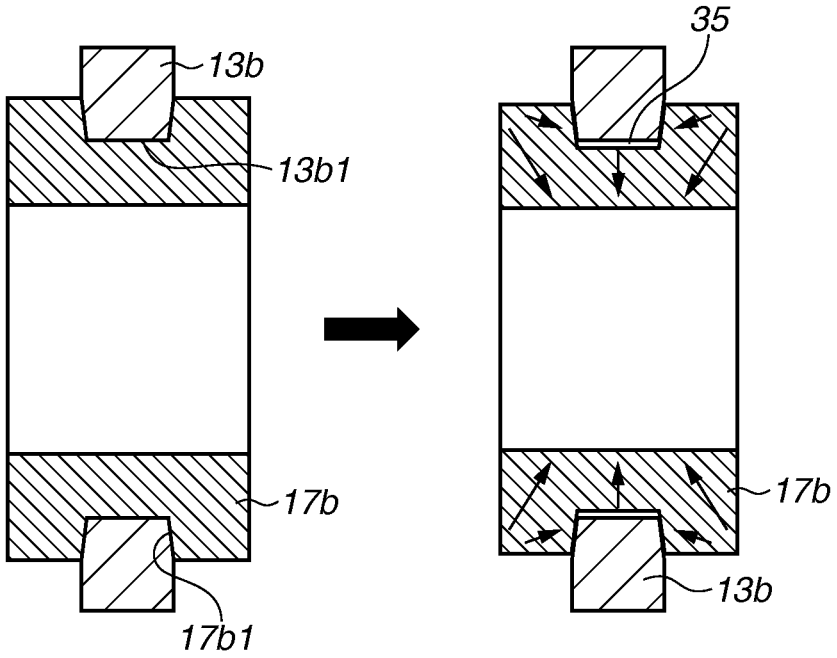
FIGS. 6A and 6B are schematic explanatory views illustrating a shape of a contact portion of a bearing portion and a drum frame member according to the first exemplary embodiment.
Figure 6B:
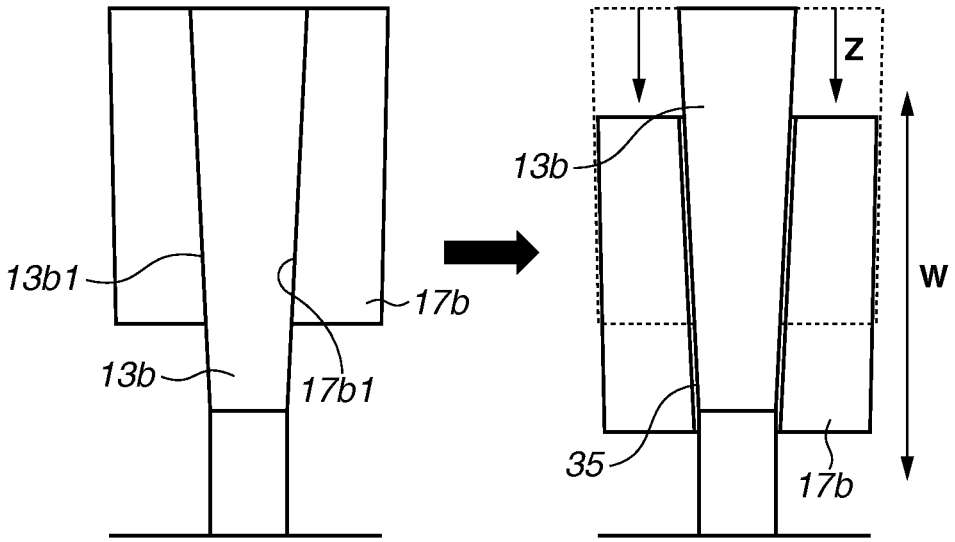

Alternatively, as illustrated in FIG. 6A, the configuration may be such that the bearing contact portion 17*b*1 of the charging roller bearing 17*b* is in contact with the contact portion 13*b*1, and formed so as to interpose the charging roller bearing supporting portion 13*b*. In this case, the charging roller bearing 17*b*, when shrinking after molding, shrinks so as to interpose the charging roller bearing supporting portion 13*b* therein. This, therefore, causes no gap to be formed between the contact portion 13*b*1 of the drum frame member 13 and the bearing contact portion 17*b*1 of the charging roller bearing 17*b*, which causes the charging roller bearing 17*b* to be less movable with respect to the charging roller bearing supporting portion 13*b*. Then, as illustrated in FIG. 6B, the contact portion 13*b*1 is tilted with respect to the Z-direction so that a gap 35 is formed when the charging roller bearing 17*b* is moved in the Z-direction, which is the movement direction. More specifically, at least one of the contact portions 13*b*1 is tilted with respect to the Z-direction so that the direction in which the contact portions 13*b*1 extend is directed to the photosensitive drum 7, for example, to the rotation center of the photosensitive drum 7. In other words, the contact portions 13*b*1 are formed so that extending directions of the respective facing contact portions 13*b*1 of the drum frame member 13 are not parallel to each other. With this configuration, when the charging roller bearing 17*b* is moved in the Z-direction from the molding position, the gap 35 can be secured between the charging roller bearing 17*b* and the charging roller bearing supporting portion 13*b*. As a result, the charging roller bearing 17*b* is smoothly movable along the contact portions 13*b*1 of the charging roller bearing supporting portion 13*b*.

In this way, a range where the charging roller bearing 17*b* is used (for example, a range W in the drawing) is set to a range obtainable after the movement from the molding position, and the tilt angles of the contact portions are optimized in such a manner that a desired gap can be obtained within the range, whereby rattling of the contact portions can be suppressed.

Further, the charging roller bearing supporting portion 13*b* of the drum frame member 13 may be configured to be free at one of the ends thereof. In this case, the facing contact portions 13*b*1 may be tilted so that the charging roller bearing supporting portion 13*b* has a shape narrowed toward the free end, whereby the charging roller bearing 17*b* can be prevented from dropping.

As described above, according to the first exemplary embodiment, the molding can be performed in a state where the charging roller bearing 17*b* is movably assembled, simultaneously with the molding of the drum frame member 13. The conventional configuration requires the step of assembling since the bearing portion is assembled with a supporting portion of a frame member or the like to be used, but herein the step of assembling the charging roller bearing 17*b* with the drum frame member 13 can be omitted. Further, the contact portions 13*b*1 of the drum frame member 13 and the bearing contact portions 17*b*1 of the charging roller bearing 17*b* are formed in shapes corresponding to each other, whereby rattling between components can be easily suppressed, and the assembling can be achieved with high accuracy.

MODIFIED EXAMPLE

Figure 7:
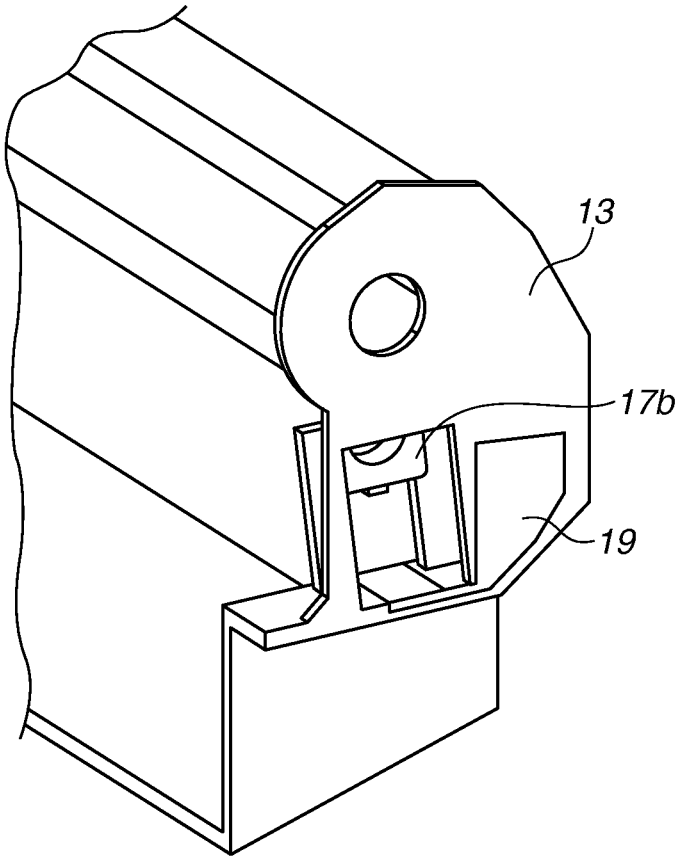
FIG. 7 is a schematic explanatory view illustrating a shape of a contact portion of a bearing portion and a drum frame member according to the first exemplary embodiment.

In the first exemplary embodiment, the configuration is such that the electrode member 19 is assembled with the drum frame member 13. The configuration, however, is not limited to this, and as illustrated in FIG. 7, the electrode member 19 may be molded integrally with the drum frame member 13 with use of a conductive material (for example, a conductive resin). Here, multicolor molding may be performed with use of the same material as that of the charging roller bearing 17*b*, which allows the electrode member 19 to be molded simultaneously with the charging roller bearing 17*b*, without a new molding step being added. With this configuration, the electrode member 19 and the step for assembling the electrode member 19 can be omitted.

Figure 8A:
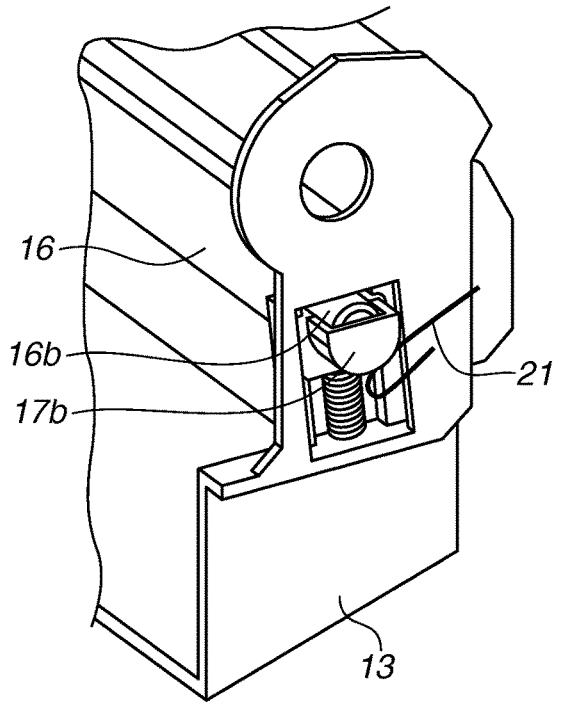
FIGS. 8A and 8B are schematic perspective views illustrating a modified example of the first exemplary embodiment.
Figure 8B:
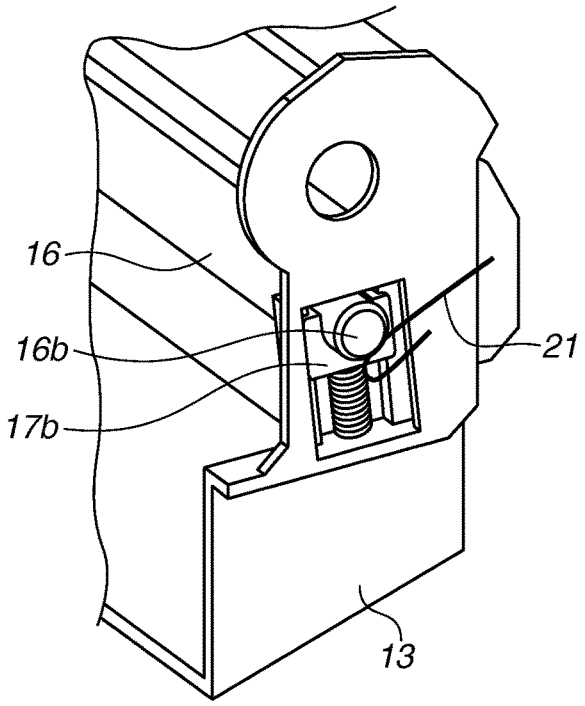

Further, in the first exemplary embodiment, the description has been given of the case where the main body electrode 21 is brought into contact with the electrode member 19. The configuration, however, is not limited to this. As illustrated in FIG. 8A, the configuration may be such that power is supplied by direct contact with the charging roller bearing 17*b*, or as illustrated in FIG. 8B, the configuration may be such that power is supplied by direct contact with the charging roller 16. With any of these configurations, an effect equivalent to that of the first exemplary embodiment can be achieved.

Figure 9:
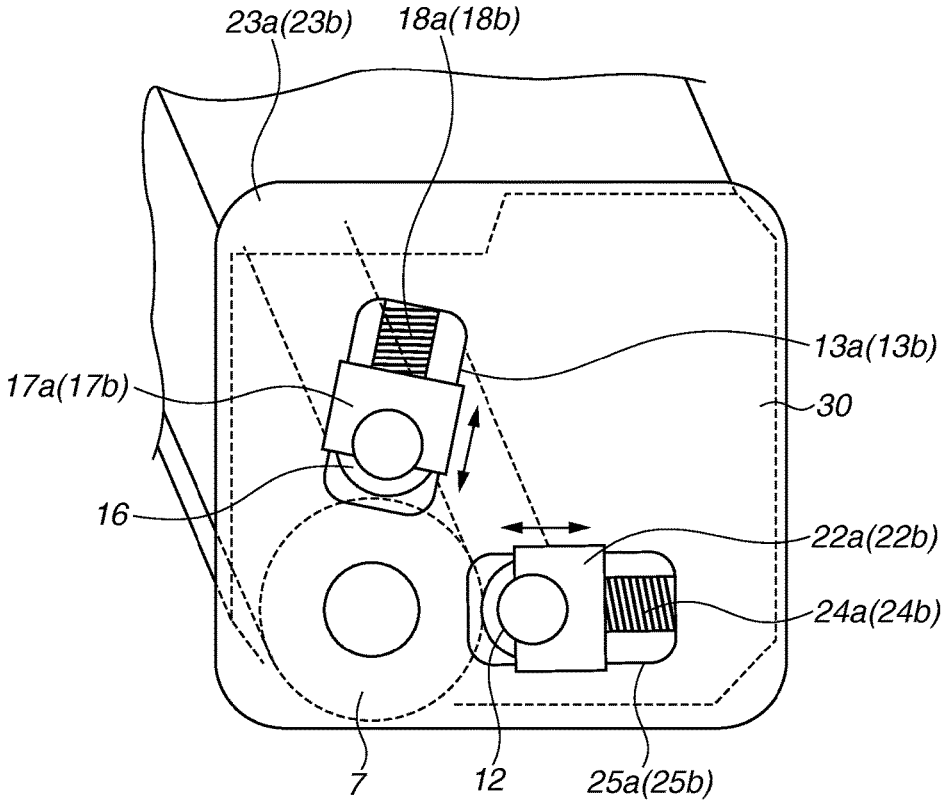
FIG. 9 is a schematic perspective view illustrating a configuration of a process cartridge according to a second exemplary embodiment.

Next, a second exemplary embodiment will be described with reference to FIG. 9. FIG. 9 schematically illustrates a configuration of a cartridge according to the second exemplary embodiment. In the first exemplary embodiment, the configuration is such that the charging roller bearings 17*a* and 17*b* are molded by multicolor molding so as to be movable with respect to the drum frame member 13. The configuration, however, may be such that the charging roller bearings 17*a* and 17*b* as well as developing roller bearings 22*a* and 22*b* are molded on bearing support members 23*a* and 23*b* by multicolor molding so as to be movable thereon. The following description places focus on differences from the first exemplary embodiment, and identical reference numerals are used for designating components identical to those in the first exemplary embodiment, while descriptions thereof are omitted.

As illustrated in FIG. 9, a cartridge according to the second exemplary embodiment includes a photosensitive drum 7, a charging roller 16 (rotating member), and a developing roller 12 (rotating member) that are rotatably supported by the bearing support members 23*a* and 23*b* provided at both ends in the longitudinal direction. The charging roller 16 and the developing roller 12 are supported by the bearing support members 23*a* and 23*b* via charging roller bearings 17*a* and 17*b* as well as the developing roller bearings 22*a* and 22*b*, in such a manner that the charging roller 16 and the developing roller 12 are movable toward the photosensitive drum 7. More specifically, as is the case with the first exemplary embodiment, the charging roller bearings 17*a* and 17*b* are configured to be engaged with charging roller bearing supporting portions 13*a* and 13*b* of the drum frame member 13, respectively, so as to be movable in a direction toward the rotation center of the photosensitive drum 7. Further, the developing roller bearings 22*a* and 22*b* are configured to be engaged with developing roller bearing supporting portions 25*a* and 25*b* of the drum frame member 13, respectively, so as to be movable in a direction toward the photosensitive drum 7, for example, in a direction toward the rotation center of the photosensitive drum 7. As is the case with the charging roller bearing supporting portion 13*b*, the developing roller bearing supporting portions 25*a* and 25*b* (regulation portions) are configured to be engaged with the developing roller bearings 22*a* and 22*b*, respectively, and are formed to have a rail shape so as to regulate movements other than those in the movement direction.

The charging roller bearings 17*a* and 17*b* are respectively provided with compression springs 18*a* and 18*b* as urging units in such a manner that the compression springs 18*a* and 18*b* are compressible toward the photosensitive drum 7. Further, the developing roller bearings 22*a* and 22*b* are respectively provided with developing compression springs 24*a* and 24*b* as urging units in such a manner that the developing compression springs 24*a* and 24*b* are compressible toward the photosensitive drum 7. The developing roller 12 and the photosensitive drum 7 are positioned so as to face each other with a minute gap (about 100 to 400 μm). To achieve this configuration, in the present exemplary embodiment, contact ring portions (not illustrated) having an outer diameter greater than the developing roller outer diameter by the length corresponding to the minute gap are provided near both end portions in the axis line direction of the developing roller 12 in regions outside a toner layer formation region. As a result, the developing roller 12 is configured to be pressed at a predetermined pressure against the photosensitive drum 7 by pressing forces of the developing compression springs 24*a* and 24*b* in a state in which a certain minute gap being maintained with respect to the photosensitive drum 7, whereby stable developing is enabled.

[Bearing Forming Method]

The charging roller bearings 17*a* and 17*b* and the developing roller bearings 22*a* and 22*b* are formed by multicolor molding so as to be movable with respect to the bearing support members 23*a* and 23*b*. As is the case with the first exemplary embodiment, the charging roller bearings 17*a* and 17*b* and the developing roller bearings 22*a* and 22*b* are formed of resins incompatible with respect to the bearing support members 23*a* and 23*b* made of the first resin. Further, on the contact point side of the contact point with the main body contact point, conductive resins are used for the second resin for forming the charging roller bearings 17*a* and 17*b*, as well as for a third resin for forming the developing roller bearings 22*a* and 22*b*, whereby conduction between the main body contact point and the process unit is ensured. In a case where the same material is used for the second resin and the third resin, these components can be formed by the same injection molding device. This is preferable since there is no need to provide a plurality of injection molding devices.

As described above, according to the second exemplary embodiment, molding is integrally performed as a multicolor molded component 30 having a plurality of bearing portions movable with respect to the bearing support members 23*a* and 23*b*, a step of assembling a plurality of bearing portions can be omitted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-176309, filed Aug. 29, 2014, which is hereby incorporated by reference herein in its entirety.

What is claimed is:

1. A cartridge mountable to a main body of an image forming apparatus, the cartridge comprising:

a first rotatable member;

a second rotatable member configured to act on the first rotating member;

a bearing supporting the second rotatable member rotatably;

an urging member urging the bearing in an urging direction in which the second rotatable member approaches the first rotatable member;

a frame including first and second guide portions which guide the bearing to move in the urging direction of the bearing, the first and second guide portions disposed so as to be opposed to each other across the bearing in an orthogonal direction orthogonal to both the urging direction of the bearing and a rotational axis direction of the second rotatable member, wherein the bearing includes inside and outside flanges which are opposed to each other across the first and second guide portions in the rotational axis direction of the second rotating member, and wherein the bearing and the first and second guide portions of the frame are integrally molded by injection molding, and the first and second guide portions each has a width, in the rotational axis direction of the second rotatable member, which becomes narrower as it goes in a direction away from the first rotatable member in the urging direction of the bearing.

2. The cartridge according to claim 1, wherein the first rotatable member is a photosensitive drum.

3. The cartridge according to claim 2, wherein the second rotatable member is a charging roller configured to charge a surface of the photosensitive drum.

4. The cartridge according to claim 2, wherein the second rotatable member is a developing roller configured to develop, with a developer, a latent image formed on the photosensitive drum.

5. The cartridge according to claim 1, wherein a region of the first and second guide portions where the second rotatable member is acting on the first rotatable member is farther, in the urging direction of the bearing, from the first rotatable member than a region of the first and second guide portions where the bearing and the first and second guide portions are molded by injection molding.

6. A cartridge mountable to a main body of an image forming apparatus, the cartridge comprising:

a first rotatable member;

a second rotatable member configured to act on the first rotating member;

a bearing supporting the second rotatable member rotatably;

an urging member urging the bearing in an urging direction of the bearing in which the second rotatable member approaches the first rotatable member;

a frame including first and second guide portions which guide the bearing to move in the urging direction of the bearing, the first and second guide portions disposed so as to be opposed to each other across the bearing in an orthogonal direction orthogonal to both the urging direction of the bearing and a rotational axis direction of the second rotatable member, wherein the bearing includes inside and outside flanges which are opposed to each other across the first and second guide portions in the rotational axis direction of the second rotatable member, and wherein the bearing and the first and second guide portions of the frame are integrally molded by injection molding, and the first and second guide portions each has a width, in the rotational axis direction of the second rotatable member at a first region thereof, which is narrower than that at a second region thereof, the first region being farther from the first rotatable member than the second region in the urging direction of the bearing, the first region being a region where the second rotatable member is acting on the first rotatable member, the second region being a region where the bearing and the first and second guide portions are molded by injection molding.

7. The cartridge according to claim 6, wherein the first rotatable member is a photosensitive drum.

8. The cartridge according to claim 7, wherein the second rotatable member is a charging roller configured to charge a surface of the photosensitive drum.

9. The cartridge according to claim 7, wherein the second rotatable member is a developing roller configured to develop, with a developer, a latent image formed on the photosensitive drum.

* * * * *